United States Patent [19]

Yoshihara

[11] Patent Number: 4,475,552

[45] Date of Patent: Oct. 9, 1984

[54] CORE BELT ARRANGEMENT OF A WOMAN'S GARMENT

[76] Inventor: Hiroshi Yoshihara, 3-1, Nishiazabu 3-chome, Minato-ku, Tokyo, Japan

[21] Appl. No.: 392,829

[22] Filed: Jun. 28, 1982

Related U.S. Application Data

[63] Continuation-in-part of Ser. No. 354,425, Mar. 3, 1982.

[51] Int. Cl.[3] ..... A41C 1/00

[52] U.S. Cl. ..... 128/531

[58] Field of Search ..... 128/509, 510, 531; 2/67

[56] References Cited

U.S. PATENT DOCUMENTS 1,109,987 9/1914 Hesla ..... 128/531

*Primary Examiner*—Doris L. Troutman

*Attorney, Agent, or Firm*—Jordan and Hamburg

[57] ABSTRACT

This invention discloses a core belt arrangement for a woman's garment which prevents the breasts and buttocks from getting out of shape without giving an oppressive or offensive feeling to these swaying portions of the body by arranging a flexible ribbon-like core belt on the fabric forming the woman's garment so as to pass under and support these swaying parts of the body such as the breasts, buttocks, abdominal region and the like and to be able to be fixed at arbitrary body positions.

19 Claims, 21 Drawing Figures

CORE BELT ARRANGEMENT OF A WOMAN'S GARMENT

This is a continuation-in-part application of Ser. No. 354,425 filed Mar. 3, 1982.

BACKGROUND OF THE INVENTION

This invention relates to a core belt arrangement of a woman's garment which can be worn to support and give a natural shape to a woman's breasts and buttocks without applying any compulsive force.

It is no exaggeration to say that the figure of woman is characterized by the shapes of the breasts and buttocks. Women therefore want to keep the profiles of the breasts and buttocks especially beautiful. Unlike those of a man, the breasts and buttocks of woman project significantly and are likely to sway not only during vigorous exercise but even during walking. The breasts and buttocks tend to get out of shape partly because of such motion. To prevent this, women perform special shape-up exercises such as hip-up and bust-up and usually wear clothes (especially undergarments) which give support and shape to the breasts and buttocks.

DESCRIPTION OF THE PRIOR ART

Typical examples of such undergarments include a brassiere, a corset, a girdle, pads, a body suit, and so forth, and are disclosed in prior art references such as Japanese Utility Model Laid-Open Nos. 164,331/1978, 106,604/1980, 179,824/1979, 81,913/1981 and 98,810/1981; in Japanese Patent Laid-Open No. 79,702/1981 and the like. However, the undergarments disclosed in these prior art references contrive to prevent the breasts and/or buttocks from swaying by merely pressing on them. These undergarments are capable of preventing the breasts and/or buttocks from swaying, but they eventually invite changes in form for the worse. At any rate, these undergarments have an oppressive or offensive feel when worn and are not suitable to be worn for an extended period. This is true not only of undergarments but also of swimsuits, leotards, and so forth. To keep the natural shapes of the breasts and buttocks, it is essential that pressing them from above be avoided. The most preferred method of support would be one that permits the breasts and buttocks to sway in harmony with the body when a woman moves, does not push them when she is not moving, and supports them enough to prevent them from improperly lowering.

SUMMARY OF THE INVENTION

The present invention is directed to provide a core belt arrangement of a woman's garment characterized in that a flexible ribbon-like core belt is disposed on the fabric forming a woman's garment so as to continuously pass at least under and around the sides of the breasts, under and around the sides of the buttocks and over the abdominal region and to be capable of being fixed at the shoulders or the neck above the breasts so that the flexible core belt pulls up on the breasts and buttocks from their lower and side parts and prevents them from getting out of shape without giving an oppressive or offensive feeling when worn.

BRIEF DESCRIPTION OF THE DRAWINGS

The accompanying drawings illustrate the core belt arrangement of a woman's garment for woman in accordance with several preferred embodiment of the present invention, in which.

DESCRIPTION OF THE PREFERRED EMBODIMENTS

Example 1

Figure 1:
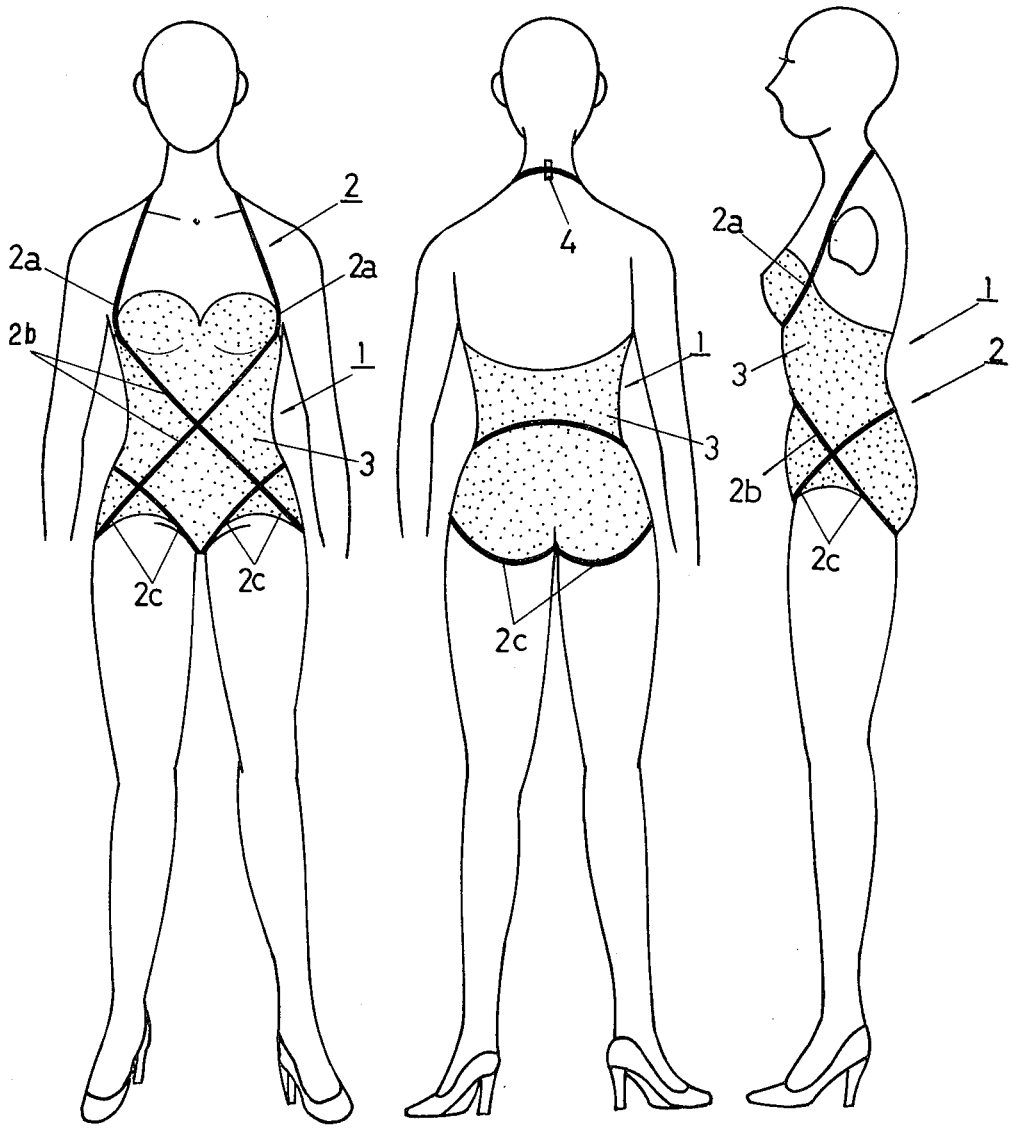
FIGS. 1(*a*), 1(*b*) and 1(*c*) are front, rear and side views of Example 1 of the present invention, respectively.

The woman's garment in accordance with this embodiment comprises a soft, flexible ribbon-like core belt 2 having an arbitrary width and a fabric 3 disposed on the upper surface of the core belt 2. As shown in FIGS. 1(*a*) and 1(*c*), the core belt 2 consists of a ring-like breast supporting portion 2*a* passing under and around the sides of the breasts, having both its ends pulled up from outside the breasts and looped around the neck, two descending portions 2*b* with their upper ends connected to the breast supporting portions 2*a* outside the breasts and extending down on either side of the navel to cross each other at the pit of the stomach, and a buttock supporting portion 2*c* passing under and around the sides of the buttocks through the pelvic region. The ends of the buttock supporting portions 2*c* are pulled out to the front of the body over the thighs and through the junctures of the groin, then cross each other on the front of the body and are connected to the respective lower ends of the descending portions 2*b*. A connector 4 is disposed on the breast supporting portion 2*a* at the back of the neck, as shown in FIG. 1(*b*), thus making the breast supporting portion 2*a* separable. The breast supporting portion 2*a* as well as the buttock supporting portion 2*c* are pulled up by the neck so that the breasts and hips are not pushed from above.

In putting on the garment having the abovementioned structure, first both legs are inserted through the leg holes formed by the buttock supporting portion 2*c*, and the upper ends of the breast supporting portion 2*a* are then stretched from the front of the body around the back of the neck to be connected to each other by the connector 4.

This embodiment provides the following effects.

(1) The breast and buttocks can be supported by merely wearing the garment of the present invention, and a brassiere or girdle is not particularly necessary,. Though the garment is specifically effective when worn as an undergarment, it can also be used as other garments which are worn against the skin, such as a swimsuit, a leotard, or the like. The same effects can also be obtained when the core belt of this embodiment is disposed on clothes in general.

(2) In this embodiment, and buttock support are accomplished by the core belt pulling up under the breasts and buttocks, unlike the conventional devices in which shape by means of the elasticity of the fabric. For this reason, this embodiment is completely free of an oppressive or offensive feeling when worn. Since the breast and buttocks are pulled up from below and not pushed from above them as in the conventional undergarments, they are not deformed when the garment is worn and the shapes are kept natural.

(3) Being made of a flexible ribbon-like material, the core belt fits through all motions of the body and does not lose its supporting effects for any postures.

(4) The breasts and buttocks are supported by the core belt alone and the fabric is used merely to cover local portions of the body and to prevent the core belt from slacking when the body is bent forward. Hence, there is no limitation to the arrangement of the fabric, and the design can be different from the existing design.

(5) The core belt is not positioned on the back of the body when the garment is worn. When the garment of this embodiment is worn as an undergarment, therefore, the back is left clear and an outerwear having a large cut on the back such as a backless dress can be worn.

(6) If the core belt is disposed so as to be positioned across the back and the waist, it also tightens the entire circumference of the waistline.

(7) If the core belt is disposed so as to cross the abdominal region, the region is pushed somewhat by the core belt so that the garment also functions as a corset.

(8) Since the upper ends of the breast supporting portion are separable at the back of the neck, the garment can be put on and taken off easily.

Example 2

Figure 2A:
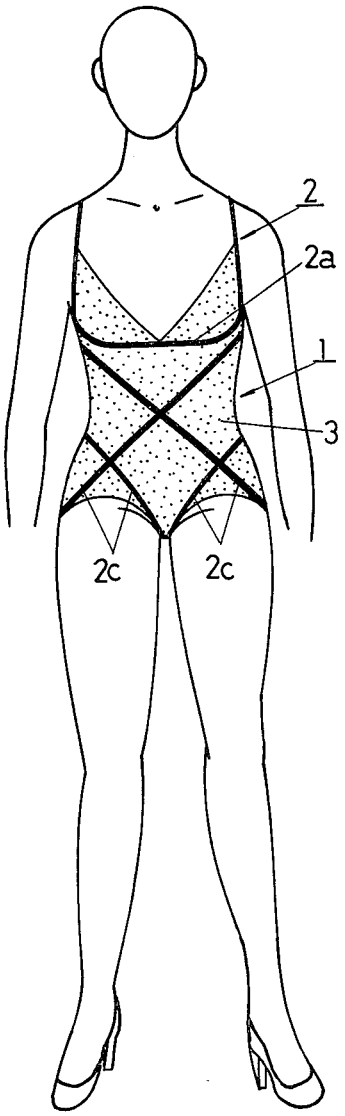
FIGS. 2(*a*), 2(*b*) and 2(*c*) are front, rear and side views of Example 2.
Figure 2B:
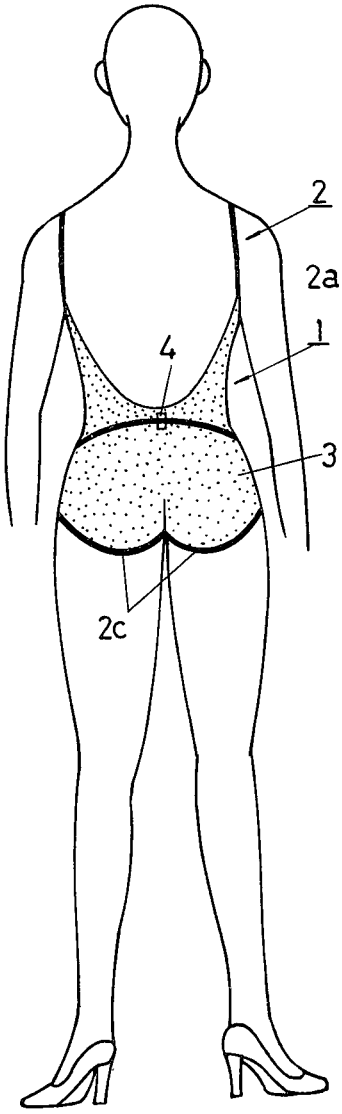
Figure 2C:
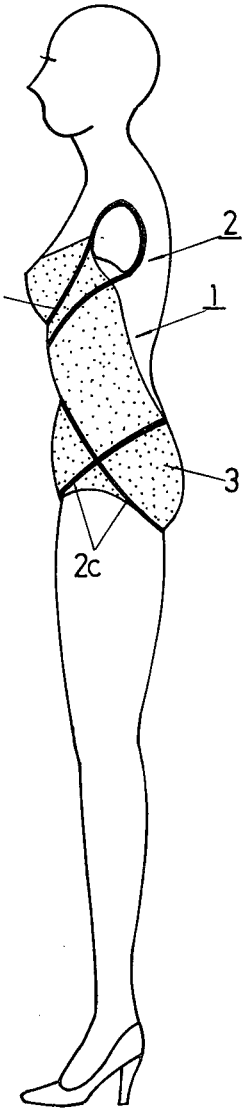
Figure 3:
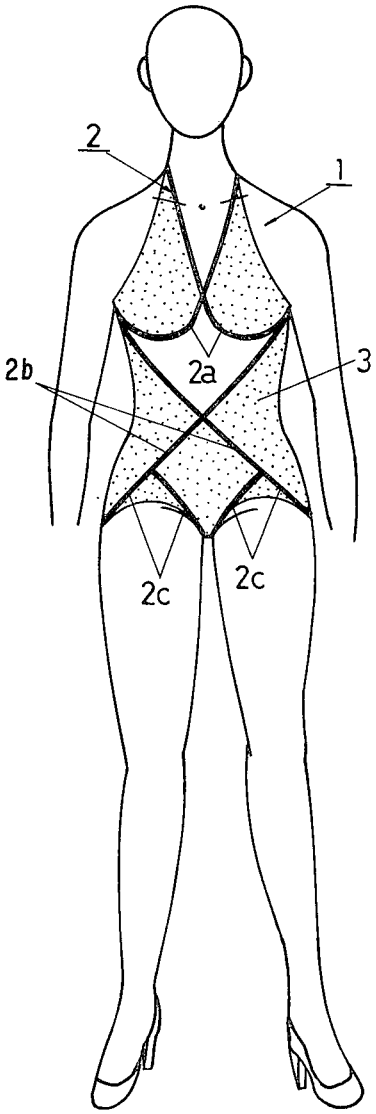
FIGS. 3(*a*), 3(*b*) and 3(*c*) are front, rear and side views of Example 3.
Figure 3:
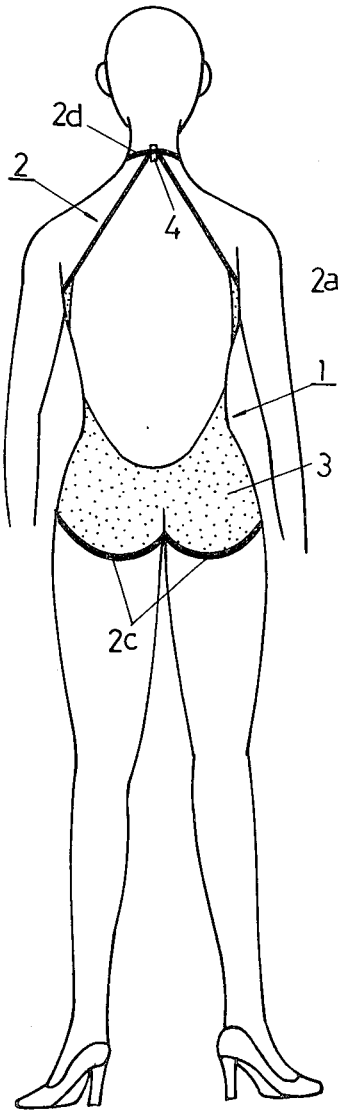
Figure 3:
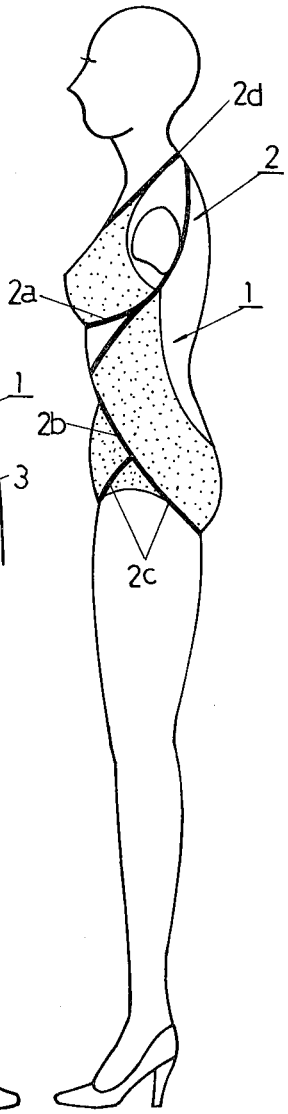

This embodiment is shown in FIG. 2. The embodiment is different from the first embodiment in that the core belt 2 rests on the shoulders and around under the breasts. Its effects are the same as those of the first embodiment.

Example 3

The woman's garment 1 in this embodiment comprises a soft, flexible ribbon-like core belt 2 having an arbitrary width and fabric 3 disposed on the core belt 2, in the same way as in the first embodiment. The core material 2 consists of a support 2*d* separable at the back of the neck via a connecting member 4, two breast supporting portions 2*a* descending from the support 2*d*, crossing between the breasts, passing under and around the outside of both breasts and below the armpits to the back of the shoulders where their upper ends are connected to the support 2*d* on the back of the body, two descending portions 2*b* having their upper ends connected to the breast supporting portions 2*a* outside of both breasts, crossing each other at their intermediate portions and descending down to the positions on either side of the navel, and two buttock supporting portions 2*c* connected to the lower ends of the descending portions 2*b* and passing through below and around the sides of the buttocks. The ends of the buttock supporting portions 2*c* are pulled out to the front of the body over the thighs and through the junctures of the groin, then cross each other on the front of the body and to connect to the lower ends of the descending portions 2*b*, respectively.

The breast supporting portions 2*a* and the buttock supporting portions 2*c* are pulled up by the support 2*d* disposed on the neck.

In putting on the garment of this embodiment, the legs are inserted into the leg holes formed by the buttock supporting portions 2*c* and the support 2*d* is put on the neck and is connected with the connector 4. As the breast supporting and buttock supporting portions 2*a* and 2*c* are pulled up, the breasts and buttocks are supported.

The same effects as those of the first embodiment are obtained by this embodiment.

Example 4

Figure 4:
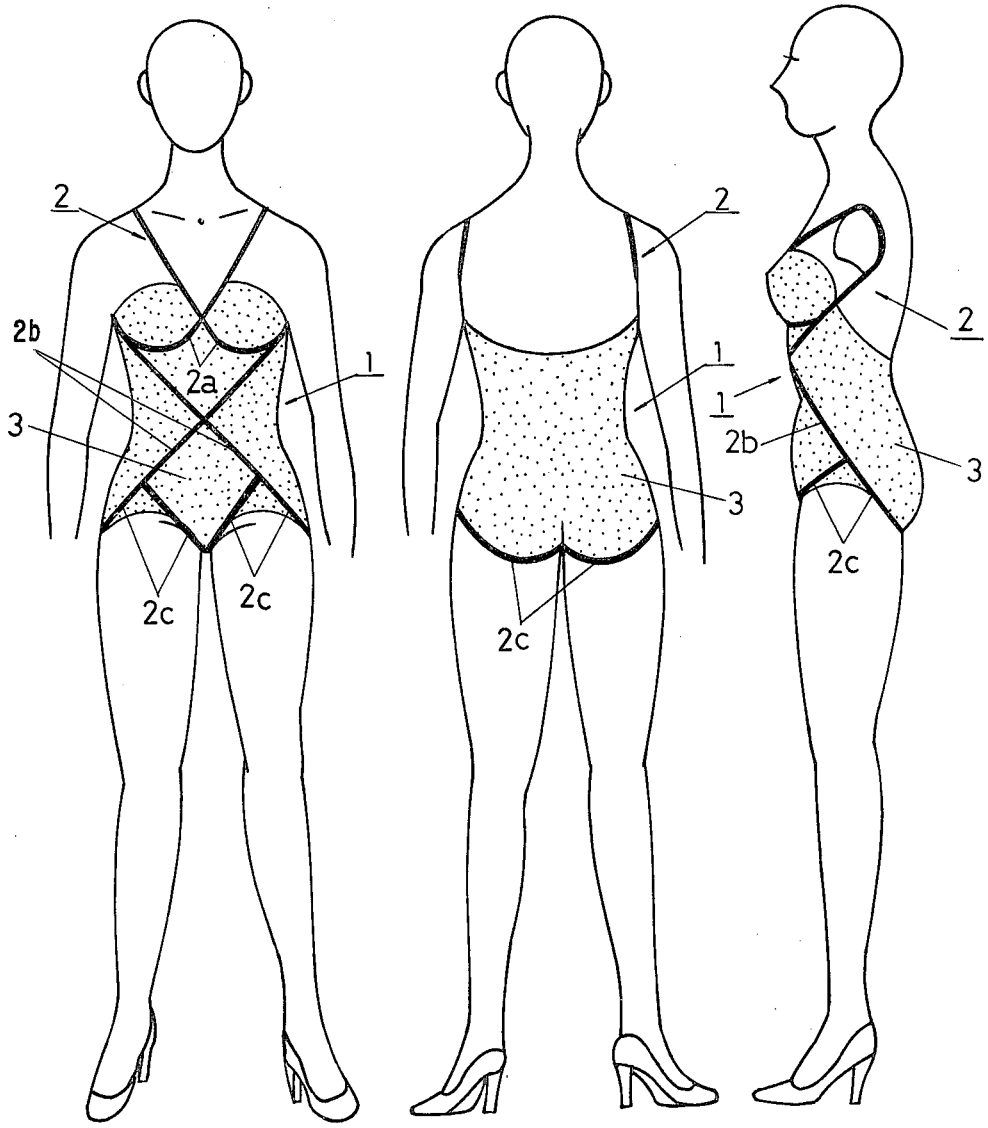
FIGS. 4(*a*), 4(*b*) and 4(*c*) are front, rear and side views of Example 4.

This embodiment is shown in FIG. 4. The embodiment is different from the one of Example 3 in that the core belt 2 rests on the shoulders. Its effects are the same as those of the first embodiment.

Example 5

Figure 5A:
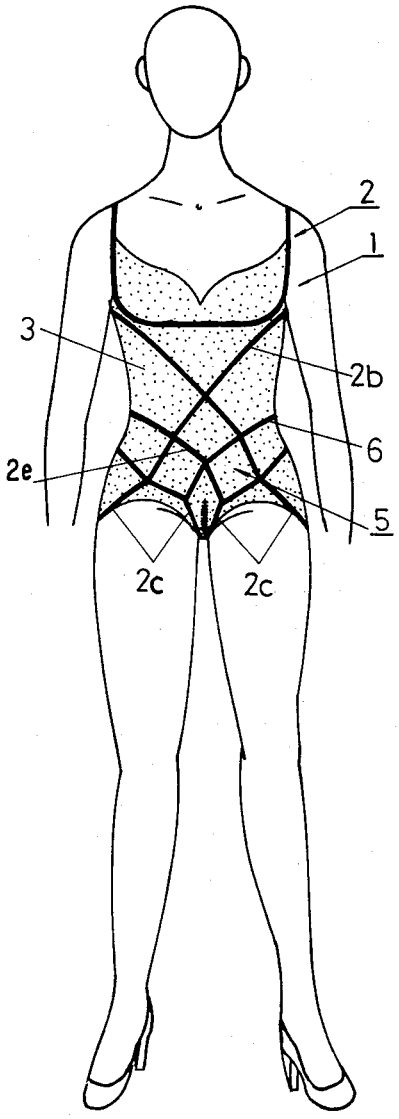
FIGS. 5(*a*), 5(*b*) and 5(*c*) are front, rear and side views of Example 5.
Figure 5B:
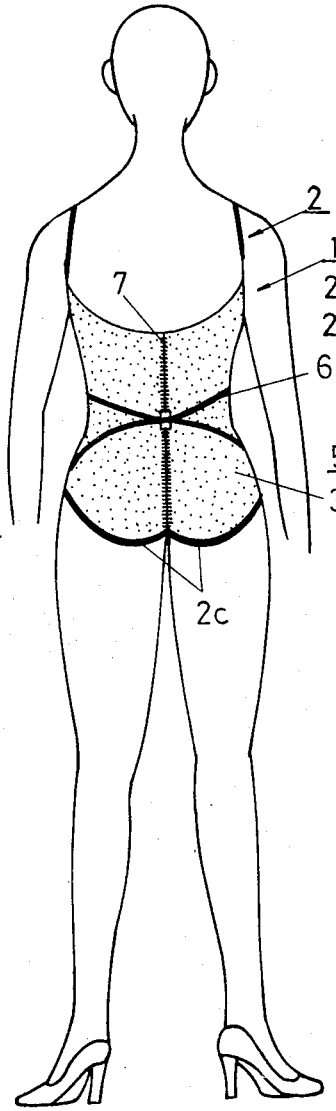
Figure 5C:
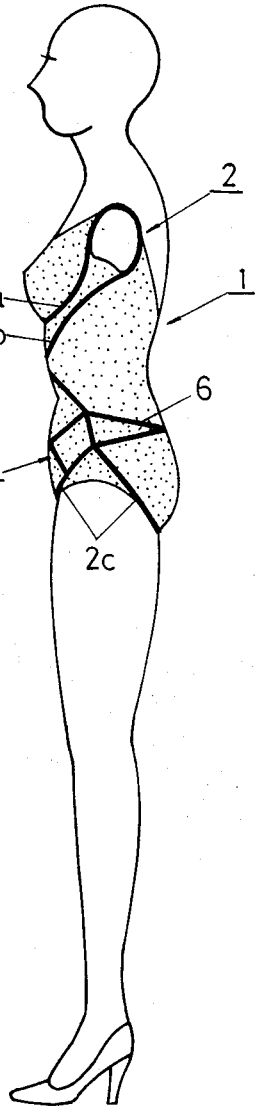

As in the aforementioned embodiments, the woman's garment 1 in accordance with this embodiment also comprises a soft, flexible ribbon-like core belt 2 having an arbitrary width and fabric 3 disposed on the upper surface of the core belt 2. As shown in FIG. 5, the core belt 2 consists of a breast supporting portion 2*a* passing over the shoulders so as to support the breasts, a buttock supporting portion 2*c*, descending portions 2*b* for connecting the breast supporting portion 2*a* to the buttock supporting portion 2*c* and woven portions 2*e* forming a tortoise shell pattern 5 on the abdomen.

As shown in FIG. 5(*a*), the breast supporting portion 2*a* passes over the shoulders and then passes under and around the sides of the breasts. As shown in FIGS. 5(*a*) and 5(*c*), the upper ends of the descending portions 2*b* are connected to the part of the breast supporting portion 2*a* above the shoulders and the lower ends of the descending portions 2*b* descend to positions on either side of the pit of the stomach.

As shown also in FIGS. 5(*a*) and 5(*c*), the buttock supporting portions 2*c* are connected to the lower ends of the two descending portions 2*b*, pulled out to the front of the body over the thighs and over the sides and under the buttocks through the junctures of the groin and passes on either side of the navel to where its ends are connected to the lower ends of the descending portions 2*b*. This buttock supporting portion 2*c* forms the leg insertion portions when the garment is put on. As shown in FIG. 5(*a*), a woven portion 2*e* is formed by the diamond-shaped portions defined by the descending portions 2*b* and the parts of the buttock supporting portions 2*c* which are pulled out toward the front of the body, thereby forming a tortoise shell pattern.

The ends of an auxiliary core belt 6, made of the same material as the core belt 22 and disposed around the waist, are connected to the lower ends of the descending portions 2*b* as shown in FIG. 5 so as to pull the tortoise shell portion 5 in the transverse direction. The auxiliary core belt 6 and a fabric 3 (to be described below) are separable by a fastener 7 disposed at the center of the back, as shwon in FIG. 5(*b*).

Thus, both breast supporting portion 2*a* and buttock supporting portions 2*c* pass around the neck and are pulled up.

This embodiment can be put on in the same way as the abovementioned embodiment, and the upper ends of the breast supporting portion 2*a* pass over the shoulders. The core belt 2 is pulled up to support the breasts and buttocks while the tortoise shell portion 5 pulls in the waist and abdominal regions.

The same effects as in the foregoing embodiments can also be obtained in this embodiment. Since the tortoise shell portions 5 push the abdominal and waist regions in this embodiment also functions as a corset.

Example 6

Figures 6A, 6B, 6C:
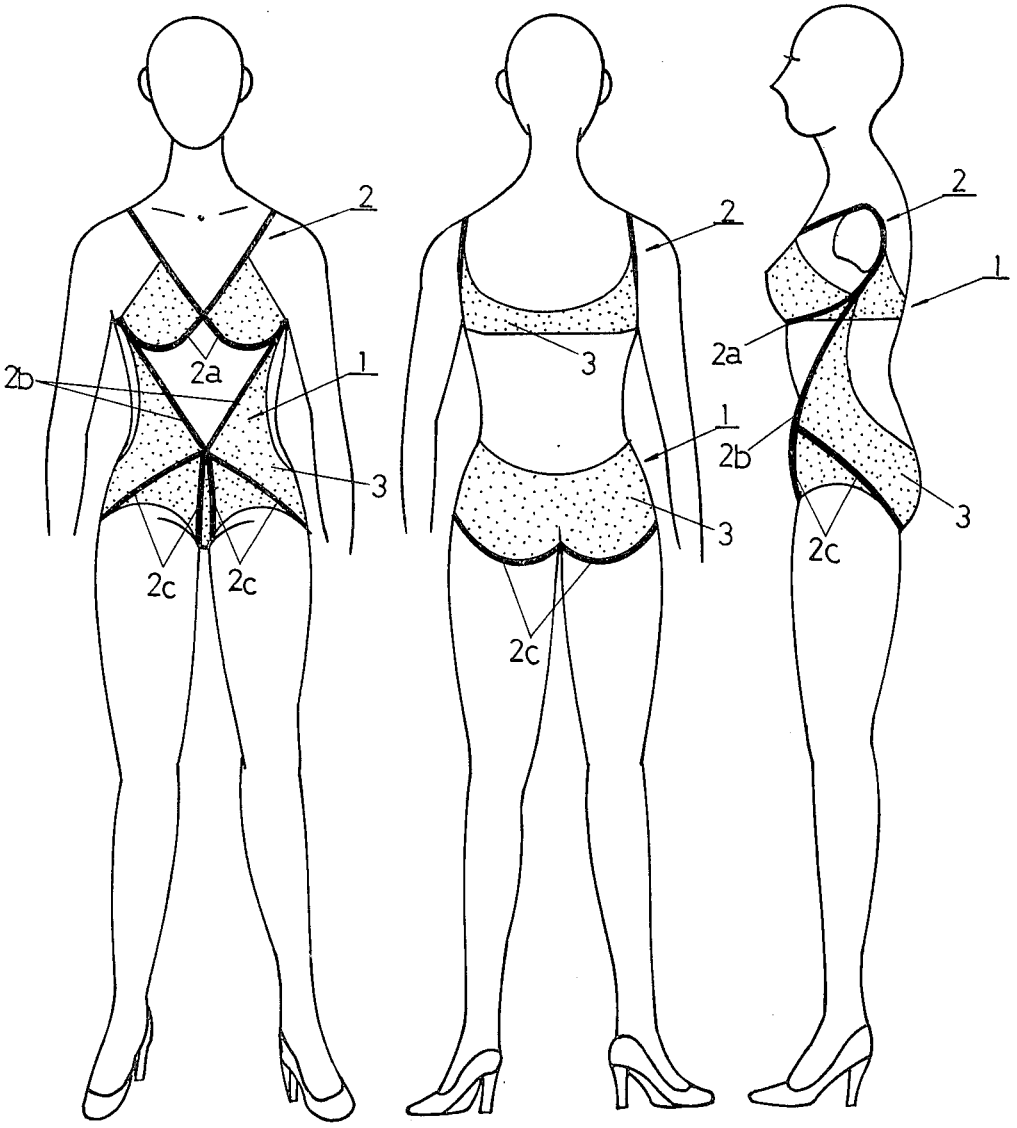
FIGS. 6(*a*), 6(*b*) and 6(*c*) are front, rear and side views of Example 6.

In the embodiment shown in FIG. 6, the garment 1 comprises a soft, flexible ribbon-like core belt 2 having a predetermined width and fabric 3 disposed on the upper surface of the core belt 2 in the same way as in the foregoing embodiments.

As shown in FIGS. 6(*a*) and 6(*b*), the core belt 2 consists of a breast supporting portions 2*a* passing under and around the outsides of the breasts so as to cross each other between the breasts and be anchored to the opposite shoulders, descending portions 2*b* descending from the back of both shoulders down to the navel through the armpits, and a buttock supporting portion 2*c* disposed under and on the sides of the buttocks extending from the lower ends of the descending portions 2*b* through the pelvic region. The ends of the buttock supporting portions are pulled toward the front of the body over the thighs and through the junctures of the groin to be connected to the lower ends of the descending portions 2*b* at the pelvic area.

The breast supporting portion 2*a*, the buttock supporting portion 2*c* and the descending portions 2*b* are pulled up by the shoulders.

The garment of this embodiment can be worn in the same way as in the foregoing embodiments. When the garment is put on, the breast supporting portion 2*a*, the buttock supporting portion 2*c* and the descending portions 2*b* are pulled up, thereby supporting the breasts and buttocks.

This embodiment provides the same effects as the foregoing embodiments.

Example 7

The women's garment 1 in this embodiment comprises a soft, flexible ribbon-like core belt 2 having a predetermined width and fabric 3 disposed on the upper surface of the core belt 2.

Figure 7A:
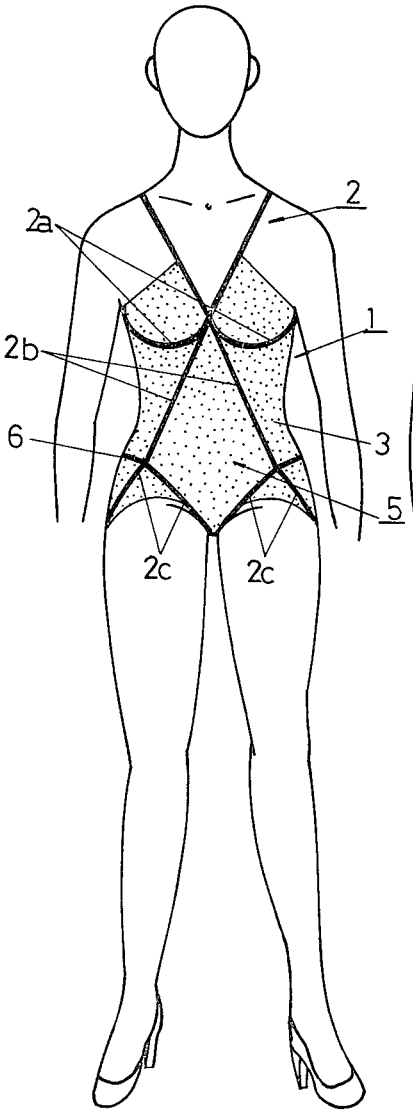
FIGS. 7(*a*), 7(*b*) and 7(*c*) are front, rear and side views of Example 7.
Figure 7B:
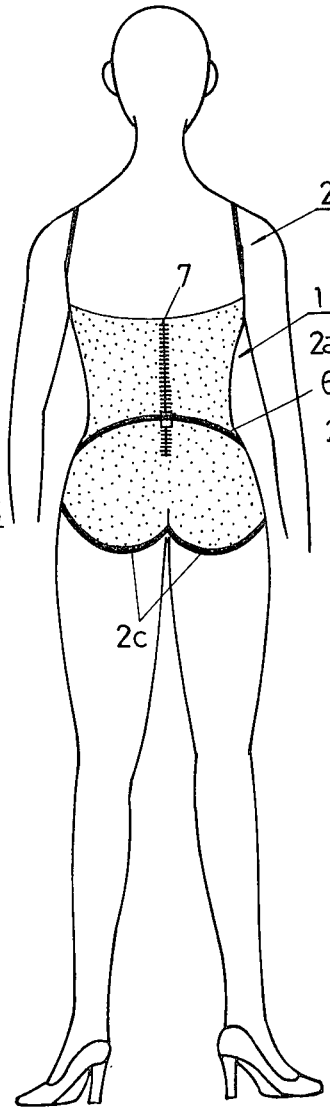
Figure 7C:
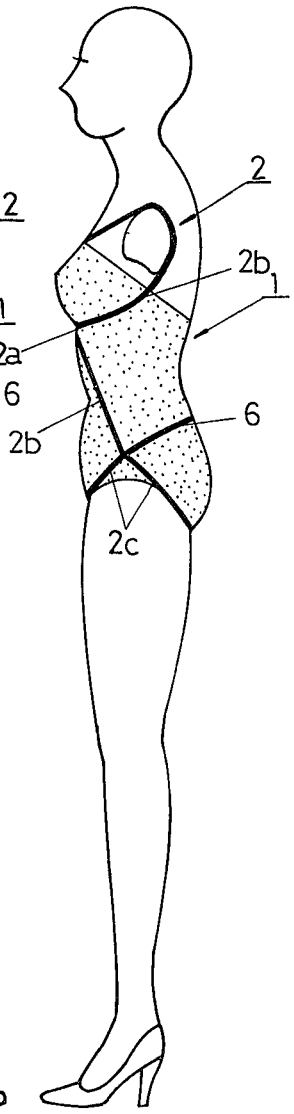

As shown in FIGS. 7(*a*) and 7(*c*), the core belt 2 consists of a breast supporting portion 2*a* passing under and around the outsides of the breasts so as to cross each other between the breasts and be anchored to the opposite shoulders, descending portions 2*b* bifurcated and descending from between the breasts down to either side of the navel, and a buttock supporting portion 2*c* passing under and on the sides of the buttocks extending from the lower ends of the descending portion 2*b* through the pelvis via the junctures of the groin and are pulled out to the front of the body over the thighs where they are connected to the lower ends of the descending portions 2*b* at the positions on either side of the navel. The ends of an auxiliary core belt 6 disposed around the waist are also connected to the lower ends of the descending portions 2*b* so that a tortoise shell pattern 5 is formed by the descending portions 2*b* and the buttock supporting portions 2*c* on the abdominal region to push the abdomen in as shown in FIG. 7(*a*). The auxiliary core belt 6 and the fabric 3 (to be described below) are separably connected by a fastener 7 on the back, as shown in FIG. 7(*b*).

The breast supporting portions 2*a*, the buttock supporting portions 2*c* and the descending portions 2*b* are pulled up by the shoulders.

The garment of this embodiment can be put on in the same way as in the foregoing embodiments. When the garment is put on, the breast supporting portion 2*a* and the buttock supporting portion 2*c* are pulled up to support the breasts and buttocks. The tortoise shell portion 5 formed by the core belt 2 and the auxiliary core belt 6 on the abdominal region push the waist and abdomen regions in.

The garment of this embodiment provides the same effects as those of the foregoing embodiments and also serves as a corset because the tortoise shell portion pushes the waist and abdominal region in.

Though the soft, flexible ribbon-like material having a predetermined width is used as the core belt 2 in the foregoing embodiments, it is also possible to use a round ribbon-like material having partial flexibility. Disposition of the core material and fabric is not limited to those described in the foregoing embodiments. It is preferred to use "Power Net", the tradename of a product of Toyo Boseki K.K., as the core belt in the foregoing embodiments, as an example.

In conjunction with flexibility of the core belt 2, it is sometimes preferred that different levels of flexibility be provided in accordance with the specific portions of the body. In such a case, the width of the core belt 2 may be suitably adjusted or slits may be put in the edges of the core belt 2 in its transverse direction. This makes it possible to give a single core belt varying levels of flexibility. In order to allow uniform body motion, it is preferred that the core belt be disposed in such a manner that the right and left halves are symmetric with each other or the core belt is endless as a whole.

Though the garments in the foregoing embodiments have the shape of a swimsuit, the garments of this invention are not particularly limited to a swimsuit but it can be adapted to the underwear in general and to the intermediate garments and clothing, thus making it possible to reduce the number of garments worn.

What is claimed is:

1. A core belt arrangement on a woman's garment comprising a fabric material formed as a woman's garment, and a flexible, ribbon-like core belt disposed on said fabric, said core belt having a first section passing underneath the breasts to provide support and prevent swaying of the breasts, said core belt having a second section passing underneath the buttocks to provide support and prevent swaying of the buttocks, said core belt having a third section crisscrossing the abdominal region to provide support for the abdominal region.

2. A core belt according to claim 1, wherein said first section of said core belt passes continuously under and around the sides of breasts, said second section of said core belt passing continuously under and around the sides of the buttocks, said core belt having a fourth and fifth section passing over each shoulder.

3. A core belt according to claim 2, wherein said first section of said core belt passes continuously underneath and around the outside of the breasts, said second section passing continuously under and around the sides of the buttocks.

4. A core belt according to claim 3, said core belt has a sixth section passing around the small of the back and having a connection connecting said sixth section at the small of the back.

5. A core belt according to claim 3, wherein said core belt has a sixth section crisscrossing at the small of the back, and a connector connecting said sixth section at the small of the back.

6. A core belt according to claim 5 further comprising a zipper on said garment extending vertically along the back.

7. A core belt according to claim 5, wherein said third section is formed in a diamond-like configuration over the abdominal region.

8. A core belt according to claim 2, wherein said first section of said core belt passes continuously underneath and crisscrosses between the breasts, said second section passing continuously under and around the sides of the buttocks.

9. A core belt according to claim 1, wherein said first section of said core belt passes continuously under and crisscrosses between the breasts, said second section of said core belt passing continuously under and around the sides of the buttocks, said core belt having a fourth section passing around and behind the neck, and a connector connecting said fourth section behind the neck.

10. A core belt according to claim 9, wherein said core belt has a fifth section passing underneath the arms and connected to said fourth section behind the neck.

11. A core belt according to claim 1, wherein said core belt comprises a single endless length of flexible ribbon-like material.

12. A core belt according to claim 1, wherein said garment is a swim suit.

13. A core belt according to claim 1, wherein said garment is a leotard.

14. A core belt according to claim 1, wherein said first section of said core belt is constructed and arranged to pull up on the breasts and said second section is constructed and arranged to pull up on the buttocks.

15. A core belt according to claim 1, wherein said core belt is symmetrically disposed.

16. A core belt arrangement on a woman's garment comprising a fabric material formed as a woman's garment, and a flexible ribbon-like core belt disposed on said fabric, said core belt having a first section passing along the sides of the breasts to provide support and prevent swaying of the breasts, said core belt having a second section passing underneath the buttocks to provide support and prevent swaying of the buttocks, said core belt further having a third section crisscrossing the abdominal region to provide support for the abdominal region.

17. A core belt according to claim 16, wherein said first section of said core belt passes continuously around the sides of the breasts, said second section of said core belt passes continuously under and around the sides of the buttocks, said core belt having a fourth section passing around and behind the neck, and a connector connecting said fourth section behind the neck.

18. A core belt according to claim 16, wherein said third section crisscrosses the abdominal region in a plurality of locations.

19. A core belt according to claim 16, wherein said second section crisscrosses the sides of the buttocks.

* * * * *